US009899762B2

(12) United States Patent
Levine

(10) Patent No.: US 9,899,762 B2
(45) Date of Patent: Feb. 20, 2018

(54) ELECTRICAL RECEPTACLE

(71) Applicant: Steven Levine, Collegeville, PA (US)

(72) Inventor: Steven Levine, Collegeville, PA (US)

( * ) Notice: Subject to any disclaimer, the term of this patent is extended or adjusted under 35 U.S.C. 154(b) by 109 days.

(21) Appl. No.: 15/137,774

(22) Filed: Apr. 25, 2016

(65) Prior Publication Data

US 2016/0315408 A1 Oct. 27, 2016

Related U.S. Application Data

(60) Provisional application No. 62/153,369, filed on Apr. 27, 2015.

(51) Int. Cl.

| | |
|---|---|
| ***H01R 13/44*** | (2006.01) |
| ***H01R 13/703*** | (2006.01) |
| ***H01R 24/78*** | (2011.01) |
| *H01R 103/00* | (2006.01) |
| *H01R 43/26* | (2006.01) |
| *H01R 25/00* | (2006.01) |

(52) U.S. Cl.

CPC ..... *H01R 13/44* (2013.01); *H01R 13/703* (2013.01); *H01R 24/78* (2013.01); *H01R 25/00* (2013.01); *H01R 43/26* (2013.01); *H01R 2103/00* (2013.01)

(58) Field of Classification Search

CPC ..... H01R 13/44; H01R 13/7036

See application file for complete search history.

(56) References Cited

U.S. PATENT DOCUMENTS

| | | | | |
|---|---|---|---|---|
| 2,735,906 | A | 2/1956 | Avrunin | |
| 3,596,019 | A | 7/1971 | Koester | |
| 3,617,662 | A | 11/1971 | Miller | |
| 4,148,536 | A * | 4/1979 | Petropoulsos | H01R 13/7036 200/51.09 |
| 4,152,557 | A | 5/1979 | Busch | |
| 4,179,175 | A * | 12/1979 | Farnworth | H01R 13/7036 200/51.09 |
| 4,707,042 | A * | 11/1987 | Haden | H01R 13/7036 439/137 |
| 5,095,182 | A | 4/1992 | Thompson | |
| 5,113,045 | A * | 5/1992 | Crofton | H01R 13/7036 200/43.05 |
| 5,865,635 | A | 2/1999 | Hsiang | |
| 6,111,210 | A | 8/2000 | Allison | |
| 6,176,718 | B1 | 1/2001 | Skarie | |
| 6,183,264 | B1 * | 2/2001 | Harsanyi | H01R 13/7037 438/39 |

(Continued)

*Primary Examiner* — James Harvey

(74) *Attorney, Agent, or Firm* — Gina M. Lupino; Alissa L. Saenz

(57) ABSTRACT

An electrical outlet receptacle includes a neutral side having a neutral blade opening and a neutral port aligned with the neutral blade opening. The neutral port is configured to receive a neutral blade of an electrical plug. A neutral contact is aligned with the neutral port. The receptacle further includes a hot side having a hot blade opening and a hot port aligned with the hot blade opening. The hot port is configured to receive a hot blade of an electrical plug. A hot contact is aligned with the hot port. A connector bar having a neutral tab extending into the neutral side of the receptacle is located between the neutral port and the neutral contact, and a hot tab extending into the hot side of the receptacle is located between the hot port and the hot contact. The neutral tab and the hot tab are offset from each other.

20 Claims, 8 Drawing Sheets

(56) References Cited

U.S. PATENT DOCUMENTS

| | | | | |
|---|---|---|---|---|
| 6,229,107 | B1 | 5/2001 | Flint | |
| 6,678,131 | B2 | 1/2004 | Chapman | |
| 6,717,077 | B1 | 4/2004 | Chevarie | |
| 7,575,467 | B2 | 8/2009 | Ferguson | |
| 7,641,489 | B1 * | 1/2010 | Hsu | H01R 13/4538 200/51.09 |
| 7,967,620 | B1 | 6/2011 | Baldwin | |
| 8,202,104 | B2 | 6/2012 | Wang | |
| 8,772,655 | B2 | 7/2014 | Lee | |
| 2003/0085108 | A1 | 5/2003 | Chiang | |
| 2003/0124893 | A1 | 7/2003 | Campbell | |
| 2007/0149013 | A1 | 6/2007 | Eastham | |
| 2008/0160810 | A1 * | 7/2008 | Ferguson | H01R 13/44 439/188 |
| 2009/0305537 | A1 | 12/2009 | Esposito | |
| 2012/0252241 | A1 | 10/2012 | Projkovski | |
| 2013/0194734 | A1 | 8/2013 | Yoshikawa | |
| 2016/0315408 | A1 * | 10/2016 | Levine | H01R 13/703 |

* cited by examiner

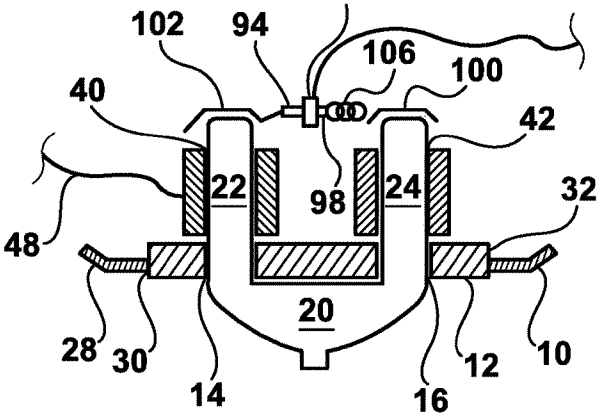
FIG. 14
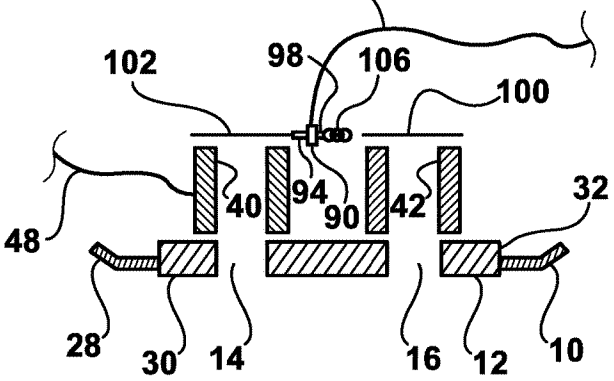
FIG. 12
FIG. 15
FIG. 13

ELECTRICAL RECEPTACLE

CROSS REFERENCE TO RELATED APPLICATION

This application claims the benefit of U.S. Provisional Patent Application No. 62/153,369, filed Apr. 27, 2015, which is incorporated by reference herein as if fully set forth.

FIELD OF INVENTION

The invention relates generally to electrical receptacles, including receptacles found in electrical outlets, power strips and extension cords. The invention relates, more specifically, to electrical receptacles having improved safety features to reduce the risk of electric shock.

BACKGROUND

Electrical receptacles are necessary to supply power to electrically powered devices. Electrical receptacles, however, pose an inherent risk of electrical shock should an individual, such as a small child, contact the electrical contacts housed within. To reduce the risk of shock, electrical receptacles are provided with narrow slots for receiving the plug of an electrical appliance, so as to prevent individuals, and in particular children, from inserting body parts or objects into the receptacle. It is still possible however, for very thin or narrow objects, to be inserted into these slots, in which case the object may contact the electrical contact and transfer current to the individual, resulting in shock. Additionally, even suitable electrical plugs can sometimes result in shock when, for example, inserted partially into a receptacle if the user's skin contacts the plug blades.

Various mechanisms have been proposed and implemented to reduce the risk of electrical shock. For example, electrical outlet safety covers, which may consist of plastic structures that are placed over the outlet may be used. In some cases such covers include prongs that are inserted into the slots of the receptacle, to affix the cover thereon and prevent insertion of other objects. Such covers can easily be removed by small children, reintroducing the risk of electric shock.

Another solution, commonly known as a tamper resistant electrical outlet, involves blocking the electrical contact ports within the outlet. This prevents a single linear object from coming in contact with the electrical elements within the outlet, but does not prevent two pronged items, such as tweezers, which may be capable of applying pressure to the hot and neutral openings at the same time, from contacting the electrical contacts.

SUMMARY

The invention relates to an electrical outlet receptacle that includes a neutral side having a neutral blade opening and neutral port aligned with the neutral blade opening. The neutral port is configured to receive a neutral blade of an electrical plug. A neutral contact is aligned with the neutral port. The receptacle further includes a hot side having a hot blade opening and a hot port aligned with the hot blade opening. The hot port is configured to receive a hot blade of an electrical plug. A hot contact is aligned with the hot port. A connector bar having a neutral tab extending into the neutral side of the receptacle is located between the neutral port and the neutral contact, and a hot tab extending into the hot side of the receptacle is located between the hot port and the hot contact. The neutral tab and the hot tab are offset from each other.

The invention further relates to an electrical outlet receptacle including a neutral side having a neutral blade opening and neutral port aligned with the neutral blade opening. The neutral port is configured to receive a neutral blade of an electrical plug. A neutral contact is located rearward of the neutral port. The receptacle further includes a hot side having a hot blade opening and a hot port aligned with the hot blade opening. The hot port is configured to receive a hot blade of an electrical plug. A hot contact is located rearward of hot port. A neutral tab is located between the neutral port and the neutral contact at a first vertical position, and a hot tab connected to the neutral tab and located between the hot port and the hot contact at a second vertical location that is offset from the first vertical location.

The invention further relates to a method of supplying electricity to an electrical plug. The method includes providing an electrical outlet receptacle including a neutral side having a neutral blade opening and neutral port aligned with the neutral blade opening. The neutral port is configured to receive a neutral blade of an electrical plug. A neutral contact is aligned with the neutral port. The receptacle further includes a hot side having a hot blade opening and a hot port aligned with the hot blade opening, the hot port configured to receive a hot blade of an electrical plug. A hot contact is aligned with the hot port. A connector bar having a neutral tab extending into the neutral side of the receptacle is located between the neutral port and the neutral contact, and a hot tab extending into the hot side of the receptacle is located between the hot port and the hot contact. The neutral tab and the hot tab are offset from each other. The method further includes providing the plug, which includes a neutral blade and a hot blade, and engaging the plug with the receptacle by inserting the neutral blade into the neutral blade opening and inserting the hot blade into the hot blade opening.

BRIEF DESCRIPTION OF THE DRAWINGS

FIG. 12 is a cross section taken along line 4-4 of FIG. 1, showing the outlet receptacle of FIG. 11.

FIG. 13 is a cross section taken along line 5-5 of FIG. 1, showing the receptacle of FIG. 11.

FIG. 14 is a cross sectional view similar to that of FIG. 12, but showing a plug engaged with the outlet receptacle.

FIG. 15 is a cross sectional view similar to that of FIG. 13, but showing a plug engaged with the outlet receptacle.

DETAILED DESCRIPTION OF THE PREFERRED EMBODIMENTS

Figure 1:
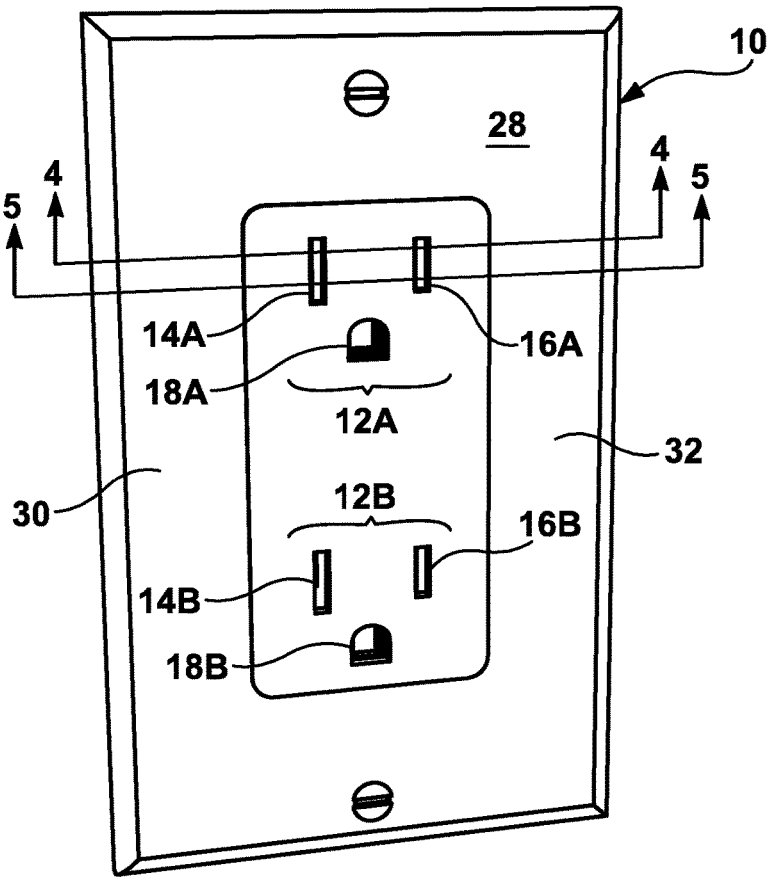
FIG. 1 is a front elevational view of an electrical outlet having a receptacle according to the invention.
Figure 2:
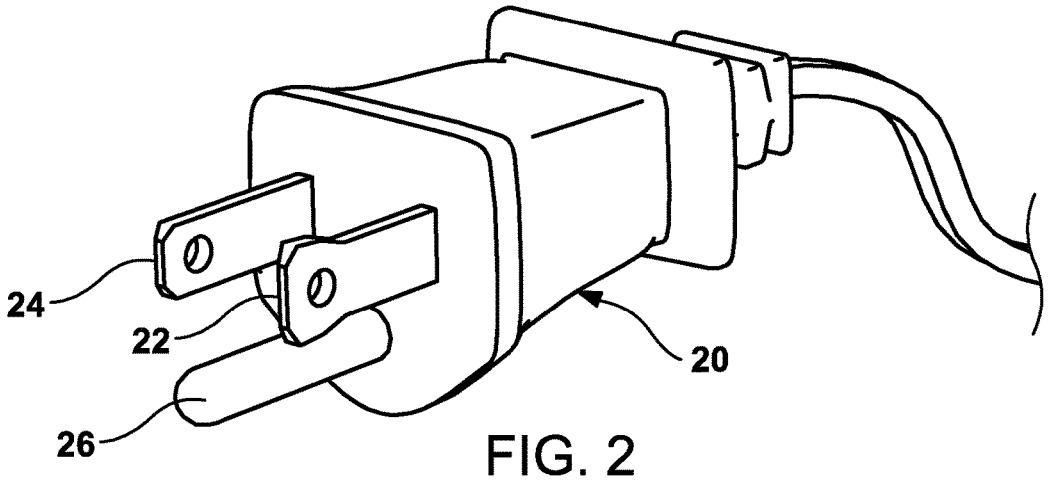
FIG. 2 is a perspective view of a plug of an electrically powered apparatus.
Figure 3:
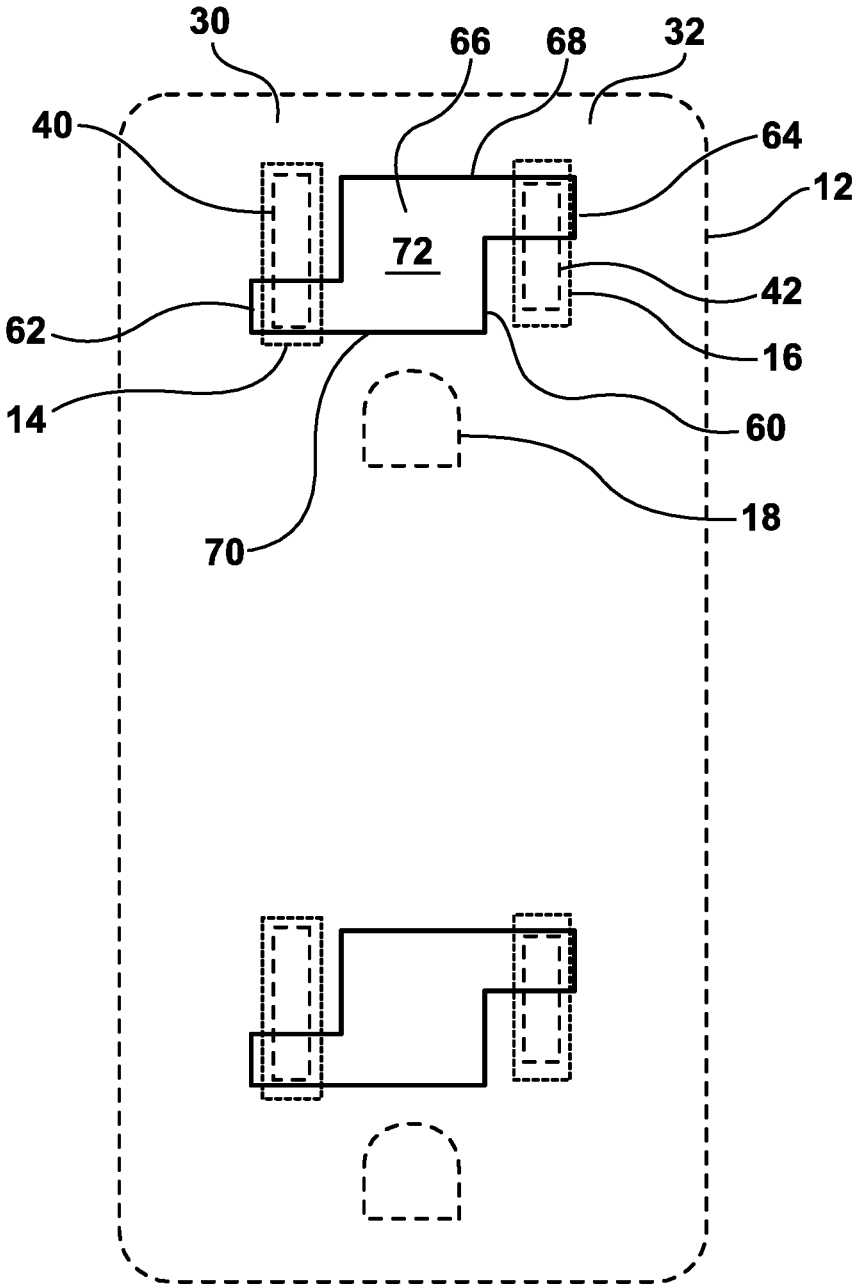
FIG. 3 is a front elevational view of an outlet receptacle according to an embodiment of the invention, showing the alignment of the connector bar with the neutral and hot blade openings of the receptacle.

Certain terminology is used in the foregoing description for convenience and is not intended to be limiting. Words such as "front," "back," "top," and "bottom" designate directions in the drawings to which reference is made. This terminology includes the words specifically noted above, derivatives thereof, and words of similar import. Additionally, the words "a" and "one" are defined as including one or more of the referenced item unless specifically noted. The phrase "at least one of" followed by a list of two or more items, such as "A, B or C," means any individual one of A, B or C, as well as any combination thereof.

The term "receptacle" or "electrical receptacle," as used herein, shall be defined as any receptacle configured to receive the blades of an electrical plug for the transmission of electricity, and shall include receptacles found in electrical outlets, power strips and extension cords. While an electrical outlet having receptacles according to the invention is described in detail, it should be understood that the invention can be embodied in any type of electrical receptacle.

Referring to FIG. 1, an electrical outlet 10 is shown. As shown, the outlet 10 is a standard grounded duplex outlet having two receptacles 12, which is commonly used in the U.S., though it should be understood that the invention can be applied to other types of electrical outlets as well. In some embodiments, the outlet 10 could have only a single receptacle 12. As shown, the outlet 10 includes an upper receptacle 12A and a lower receptacle 12B. A wall cover 28 may be provided with openings, allowing the receptacles 12 to protrude therethrough. Each receptacle 12 is configured to receive a standard grounded plug 20 of an electrically powered apparatus. As shown, each receptacle 12 includes hot 16 and neutral blade openings 14, which are parallel slots configured to receive the blades of an electrical plug 20. In the illustrated embodiment, the neutral blade opening 14 is located on the left side of the receptacle 12 and is a vertically extending slot having a first length and configured to accept a neutral blade 22 of a plug 20. The hot blade opening 16 is a vertically extending slot having a second length that may be less than the first length, and is configured to accept a hot blade 24 of the plug 20. The receptacle 12 of the illustrated embodiment further includes a grounded contact opening 18, located beneath the hot and neutral blade openings 14, 16, having a substantially half circular shape and configured to receive a grounded prong 26 of an electrical plug 20. In another embodiment, the grounding contact opening 18 may be omitted, and the receptacle 12 configured to accept only plugs not having a grounded prong 26.

Referring to FIGS. 3-9, the neutral blade opening 14 is connected to a neutral prong port 40 that houses the neutral blade 22 when the plug 20 is plugged into the receptacle 12, and the hot blade opening 16 is connected to a hot contact port 42 that houses the hot blade 24 when the plug 20 is plugged into the receptacle 12.

The neutral prong port 40 and the neutral opening 14 are located on a neutral side 30 of the receptacle 12, which is the left side in the illustrated embodiment and in standard U.S. electrical outlets, and the hot prong port 42 and the hot opening 16 are located on a hot side 32 of the receptacle 12, which is the right side in the illustrated embodiment and in standard U.S. electrical outlets.

Figure 18:
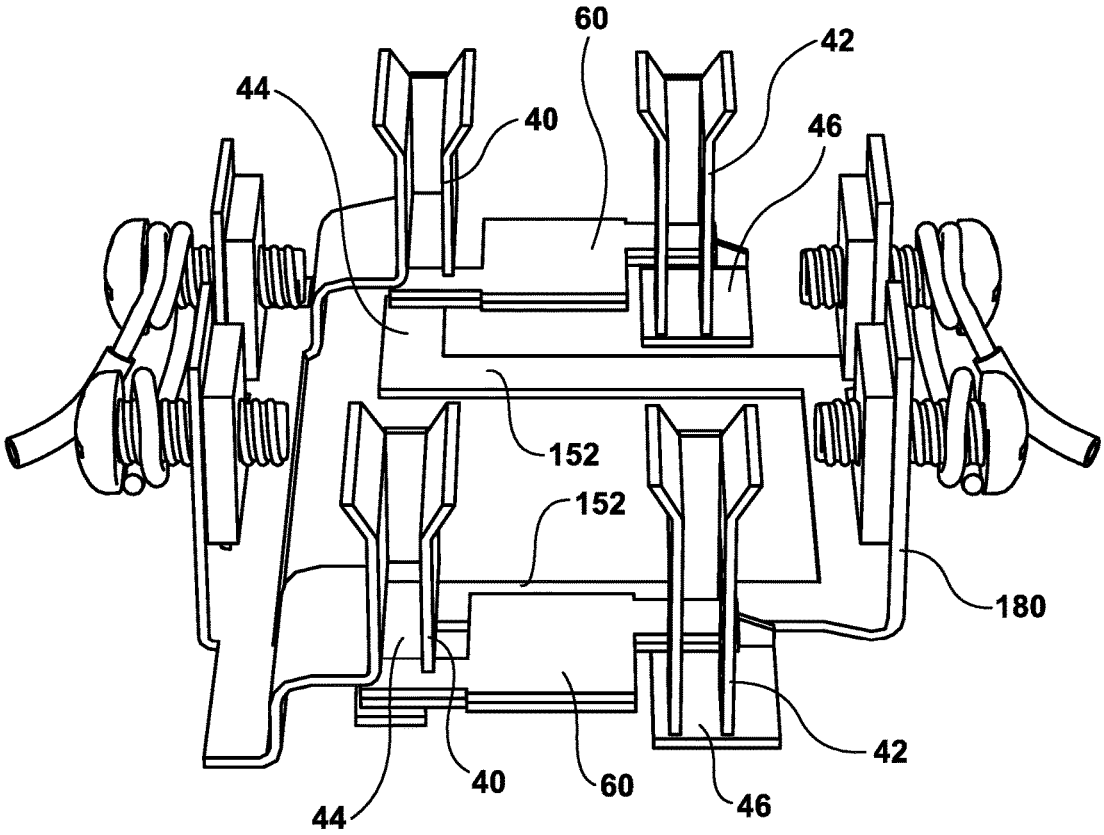
FIG. 18 is a perspective view of another embodiment of an electrical outlet according to the invention.

Referring to FIGS. 4-9 the outlet 10 further comprises a hot side output contact 46 located rearward of the hot contact port 42 and a neutral side output contact 44 located rearward of the neutral contact port 40. Hot wire 50 supplies current to 42 through the contacts 44, 46, and connector wire 52, which connects hot side output contact 46 to hot contact port 42. Another embodiment is shown in FIG. 18, in which connector wire 52 is omitted, and instead connector 152, which is formed as a sheet of stamped metal, continuous with the side bracket 180 of the outlet. Such a construction can be employed with any embodiment of the invention described herein.

Referring again to the embodiment of FIGS. 4-9, neutral contact port 40 is connected to a neutral wire 48 that returns current away from the outlet 10. In a conventional outlet, when the plug 20 is engaged with the receptacle 12, and the hot blade 24 draws current via hot prong port 42, to which hot wire 50 is directly connected, and the neutral blade 22 contacts the neutral prong port 40, to which neutral wire 48 is directly connected, to complete the circuit. In the case of a conventional electrical outlet, another conductive object having a two pronged configuration similar to that of an electrical plug 12 could be inserted into the receptacle to complete the circuit, resulting in a dangerous condition.

Referring to FIGS. 3-9, an outlet receptacle 12 according to the invention further includes a connector bar 60. As shown, the connector bar 60 is located behind the contact openings 14, 16 and contact ports 40, 42. The connector bar 60 has a horizontally extending neutral tab 62 and a horizontally extending hot tab 64. As shown, the neutral tab 62 and hot tab 64 are joined by a vertically extending link 66. As shown, the link 66 has a vertical extension, which may be, for example, substantially equal to or less than that of the neutral opening 14 or hot opening 16. A top end 68 of the link 66 may be located vertically proximate to an upper end of the neutral opening 14, and a bottom end 70 of the link 66 may be located vertically proximate to a lower end of the neutral opening 14. The link 66 is positioned substantially between the neutral side 30 and the hot side 32 of the receptacle. The neutral tab 62 extends outward perpendicularly from a first end of the link 66 and into the neutral side 30 of the receptacle 12. The first end is the bottom end 70 in the illustrated embodiment. The hot tab 64 extends outward perpendicularly from a second end of the link 66 and into the hot side 32 of the receptacle 12. The second end is the top end 68 in the illustrated embodiment. In other embodiments, the first end could be the top end 68 and the second end could be the bottom end 70. In another embodiment, the neutral tab 62 and the hot tab 64 could extend from different vertical locations along the length of the link 66. In any event, the neutral tab 62 and the hot tab 64 are misaligned, i.e., vertically offset from each other.

As shown in FIGS. 4-7, the neutral side tab 62 extends to a position in alignment with, but not contacting, the neutral side output contact 44 and the hot side tab 64 extends to a position in alignment with, but not contacting, the hot side output contact 46.

The connector bar 60 has a front surface 72 facing a frontward direction of the receptacle 12 and a rear surface 74 facing a rearward direction of the receptacle 12. The front surface 72 is formed of an insulative material, such as natural rubber or plastic. The rear surface is 74 is formed of a conductive material, such as a metallic material. The connector bar 60 is of a construction that allows it to resiliently bend. It easily bends upon application of pressure, for example from the blades of an electrical plug 20, as described in detail below, and returns to its original, substantially planar shape upon release of pressure.

Figure 6:
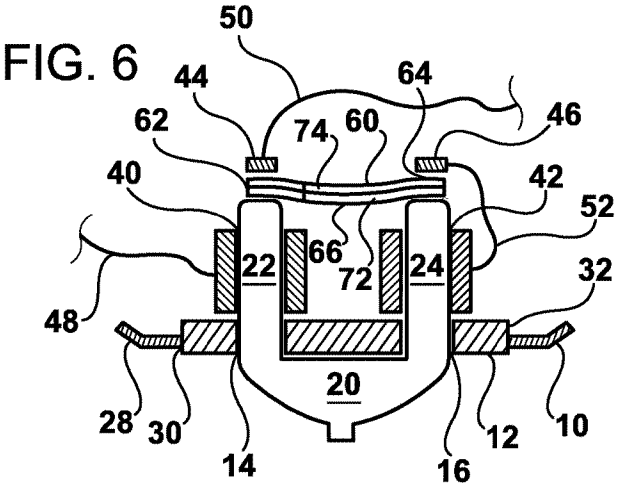
FIG. 6 is a cross sectional view similar to that of FIG. 4, but showing a plug engaged with the outlet receptacle.
Figure 7:
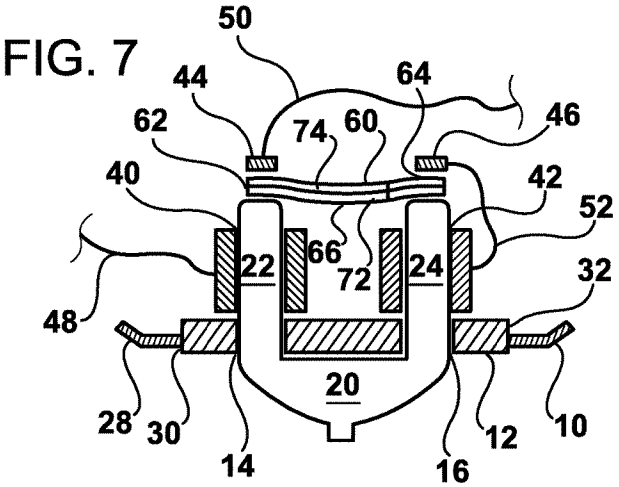
FIG. 7 is a cross sectional view similar to that of FIG. 5, but showing a plug engaged with the outlet receptacle.
Figure 4:
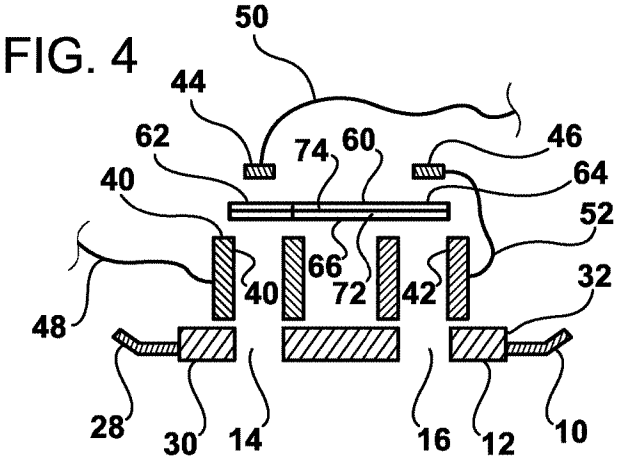
FIG. 4 is a cross section taken along line 4-4 of FIG. 1.
Figure 5:
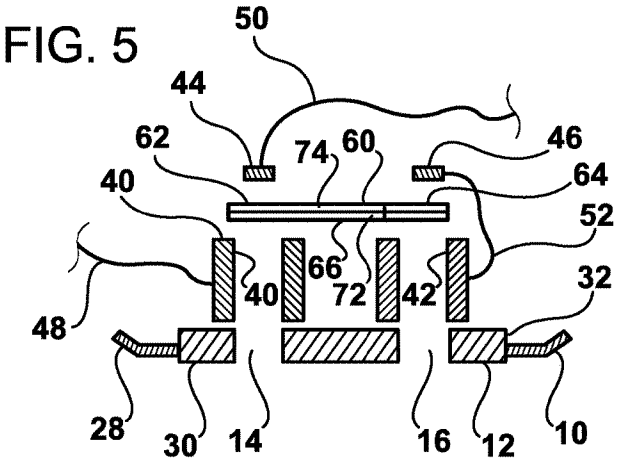
FIG. 5 is a cross section taken along line 5-5 of FIG. 1.

With reference to FIGS. 4-7, operation of an electrical outlet receptacle 12 and connector bar 60 according to the invention will be described in detail. As shown in FIGS. 4 and 5, when the plug 20 is not engaged with the receptacle 12, the connector bar 60 has a substantially planar extension, with the neutral side tab 62 in front of and aligned with the neutral side output contact 44 and the hot side tab 64 in front of and aligned with the hot side output contact 46. The neutral side output contact 44 and the hot side output contact 46 are not in communication with each other in this configuration, so no current is transferred or supplied. As shown in FIGS. 6 and 7, when the plug 20 is engaged with the receptacle 12, the neutral blade 22 contacts the neutral side tab 62 and bends the neutral side tab 62 in a rearward direction of the receptacle 12. At the same time, the hot blade 24 contacts the hot side tab 64 and bends the hot side tab 64 in a rearward direction of the receptacle 12. This bending brings the neutral side tab 62, and in particular, the conductive rear surface 74 of the connector bar 60 on the neutral side tab 62 in contact with the neutral side output contact 44. At the same time, the hot side tab 64, and in particular, the conductive rear surface 74 of the connector bar 60 on the hot side tab 64, is brought into contact with the hot side output contact 46. Accordingly, the connector bar 60 brings the neutral side output contact 44 and the hot side output contact 46 in communication with each other via the conductive rear surface 74, completing the circuit necessary for current to be supplied to an electrical apparatus associated with the plug 20.

Figure 9:
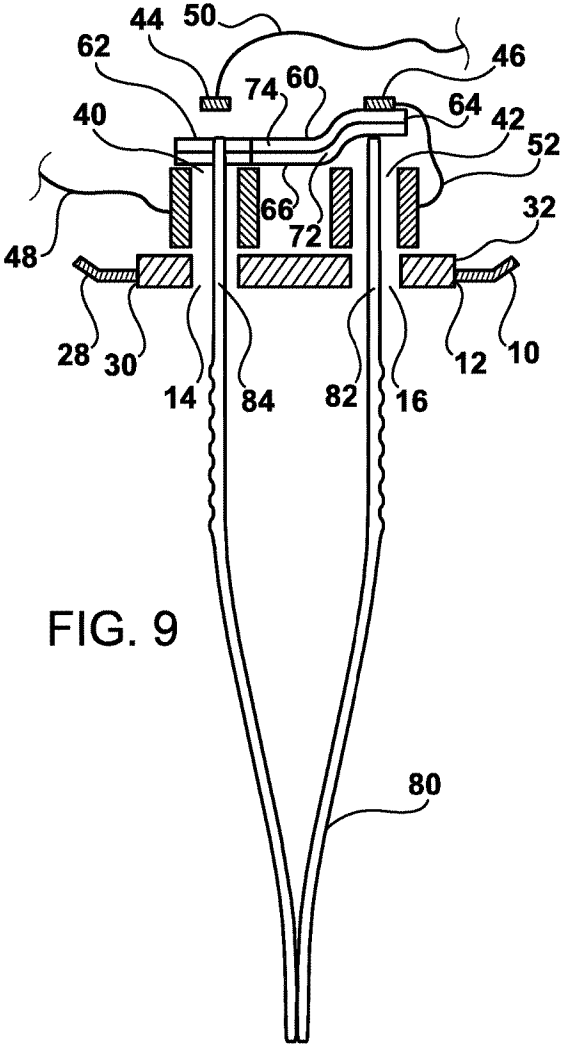
FIG. 9 is a cross sectional view similar to that of FIG. 4, but showing a pair of tweezers engaged with the outlet receptacle.
Figure 8:
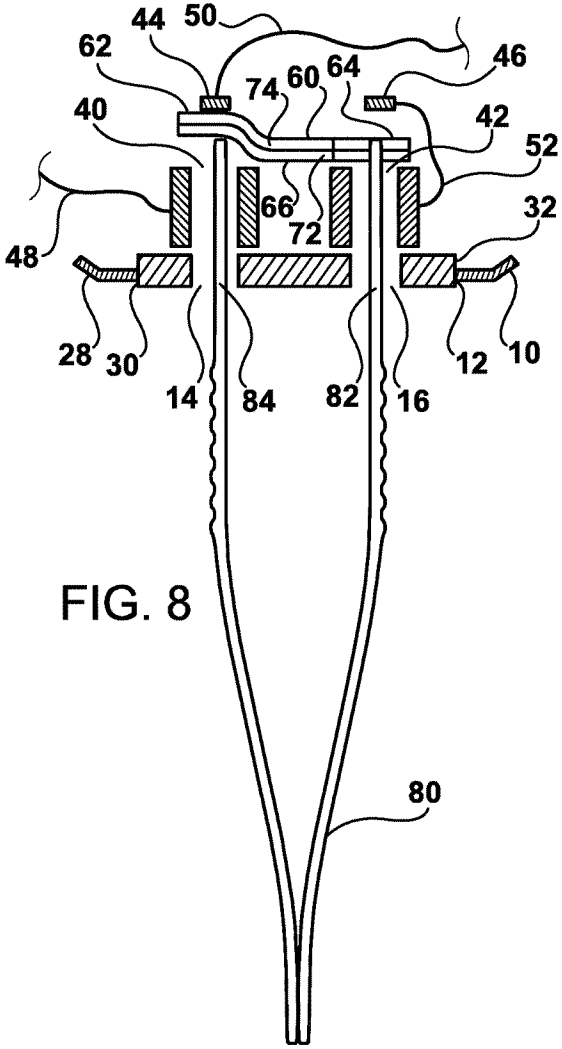
FIG. 8 is a cross sectional view similar to that of FIG.5, but showing a pair of tweezers engaged with the outlet receptacle.

Referring to FIGS. 8 and 9, two scenarios are illustrated in which a narrow, two pronged object 80 is engaged with the receptacle, which could result in a dangerous condition such as shock in the case of a conventional outlet. In the illustrated embodiment, the object 80 is a set of tweezers, but it should be understood that the outlet will respond in the same manner where other similarly sized two-pronged objects are inserted into the receptacle. As shown, a first prong 84 of the object is inserted into the neutral blade opening 14 and a second prong 82 is inserted into the hot blade opening 16. In FIG. 8, the object 80 is inserted at a first vertical position, near the lower edges of the neutral and hot blade openings 14, 16. When this occurs, the first prong 84 may bend the neutral tab 62 to bring the conductive rear surface 74 thereon in contact with the neutral side output contact 44. Because the neutral side tab 62 and hot side tab 64 are displaced from each other, the second prong 82 enters the hot blade opening 16 at a position below the hot side tab 64. The hot side tab 64, and in turn the conductive rear surface 74 thereon, does not contact the hot side output contact 46, failing to complete the circuit and enable current to be supplied. Similarly, FIG. 9 shows a scenario in which the object 80 is inserted at a second vertical position, near the upper edges of the neutral and hot blade openings 14, 16. When this occurs, the second prong 82 may bend the hot side tab 64, to bring the conductive rear surface 74 thereon in contact with the hot side contact 46. Because the neutral side tab 62 and hot side tab 64 are displaced from each other, the first prong 84 enters the neutral blade opening 16 at a position above the neutral side tab 62. The neutral side tab 62, and in turn the rear conductive surface 74 thereon, does not contact the neutral side contact 44, failing to compete the circuit and enable current to be supplied.

Figure 10:
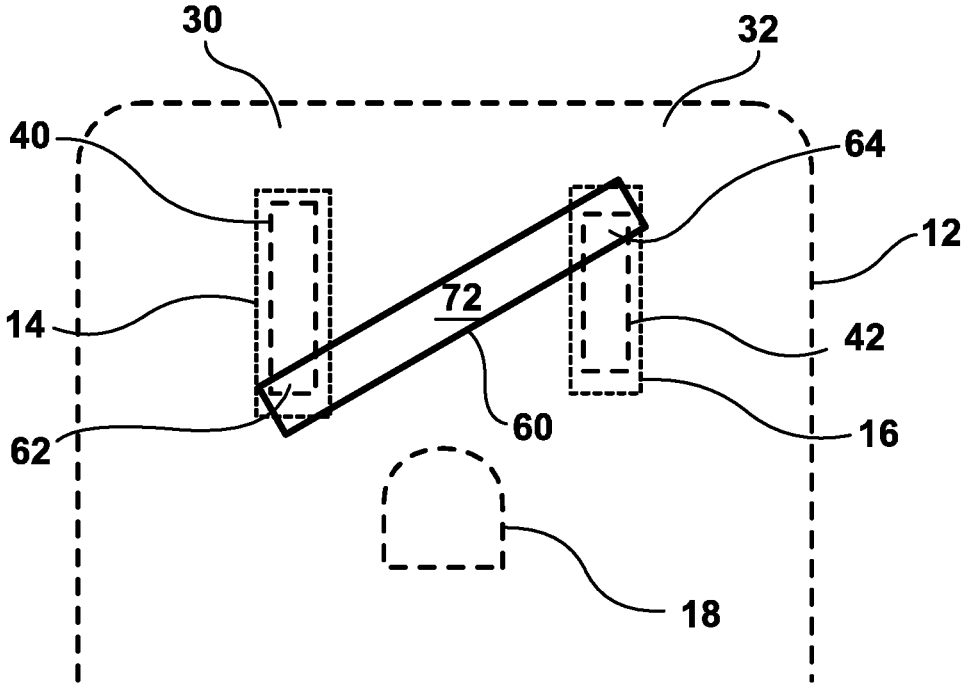
FIG. 10 is a front elevational view of an outlet receptacle according to another embodiment of the invention, showing the alignment of the connector bar with the neutral and hot blade openings of the receptacle.

Another embodiment of an electrical receptacle 12 according to the invention is shown in FIG. 10. This embodiment is similar to that of FIGS. 1-9, and only the differences will be described in detail. As shown, the connector bar 60 of this embodiment has a linear, vertical extension. As shown, the connector bar 160 is located behind the contact openings 14, 16 and in front of the contact ports 40, 42. The connector bar 160 has a neutral tab end 162, a central link portion 160 and a hot tab end 164, all of which are in alignment and formed as a single, unitary, and linear extending structure. The neutral tab end 162 is located proximate to a lower end of the neutral opening 14 and the hot tab end 164 is located proximate to an upper end of the hot opening 16. In another embodiment the diagonal extension, and in turn the positioning of the neutral tab end 162 and hot tab end 164 could be reversed, such the neutral tab end 162 is located proximate to an upper end of the neutral opening 14 and the hot tab end 164 is located proximate to a lower end of the hot opening 16.

Another embodiment of an electrical receptacle 12 according to the invention is shown in FIGS. 11-18. This embodiment is similar to the embodiment of FIGS. 1-9, and only the details will be described in detail.

Referring to FIGS. 11-17 the outlet 10 further comprises a hot side input contact bar 96 and a neutral side input contact bar 98. Hot wire 50 supplies current to the hot contact port 42 through a hot input bar 90, hot side input bar contact 96, neutral side input bar contact 98, and connector wire 52, which connects hot input bar 90 to the hot contact 42, as shown in FIG. 13. The neutral contact port 40 is connected to a neutral wire 48 that returns current away from the receptacle 12. When the plug 20 is engaged with the receptacle 12, as shown in FIGS. 14 and 15, the hot blade 24 contacts a hot side line 100, and the neutral blade 22 contacts a neutral side line 102.

Figure 11:
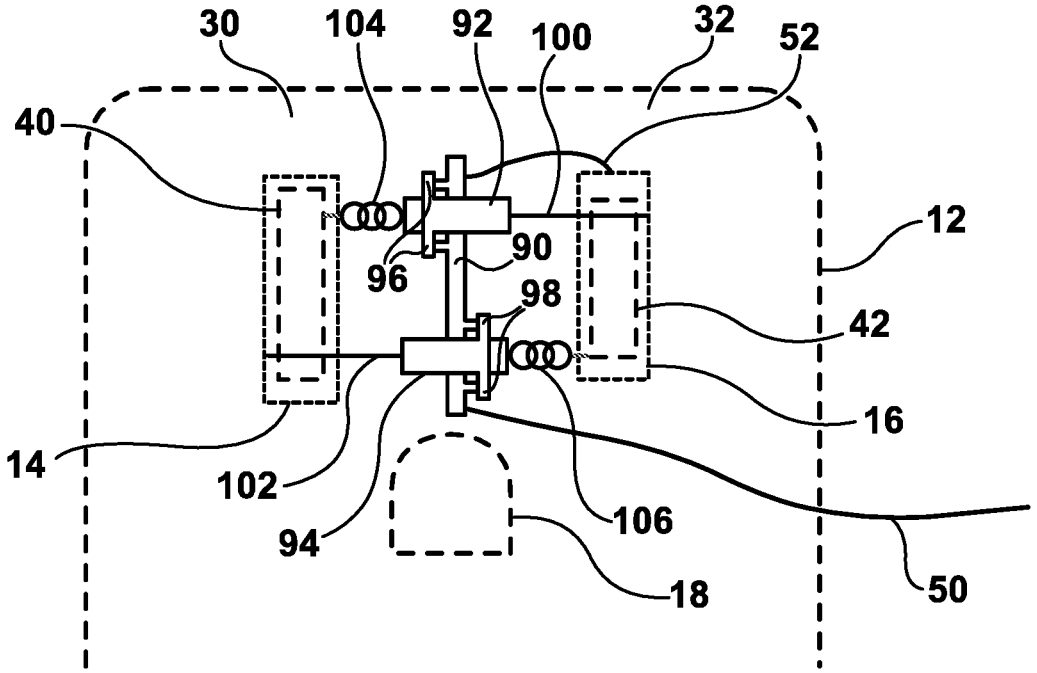
FIG. 11 is a front elevational view of an outlet receptacle according to another embodiment of the invention.

Referring to FIGS. 11-17 an outlet receptacle 12 according to the invention further includes a hot side slider 92, fixedly connected to hot line 100, and a neutral side slider 94 fixedly connected to neutral line 102. As shown, hot line 100 and neutral line 102 are located rearward of the contact openings 14, 16 and ports 40, 42. The slider contact bars 96, 98 are each fixedly associated with a slider 92, 94. Slider contact bars 96, 98 are held in constant tension away from the hot input bar 90 by springs 104 and 106. The neutral line 102 and the hot line 100 are aligned with and vertically offset from each other, as shown in FIGS. 11 and 12. The neutral line 102 extends to a position in alignment with neutral blade opening 14 and the hot line 100 extends to a position in alignment with hot blade opening 16. In the illustrated embodiment, the hot line 100 is vertically aligned with an upper portion of hot blade opening 16 and the neutral line 100 is vertically aligned with a lower portion of the neutral blade opening 14. In other embodiments this positioning could be reversed, such that the neutral line 100 is vertically aligned with an upper portion of the neutral blade opening 14 and the hot line 102 is vertically aligned with a lower portion of the hot blade opening. In other embodiments, the neutral and hot lines 100, 102 could be located at other vertical positions out of alignment with each other.

As shown in FIG. 11, the neutral side slider 94 extends to a position in horizontal alignment with, but not contacting, the hot input bar 90 and the hot side slider 92 extends to a position in horizontal alignment with, but not contacting, the hot input bar 90.

The sliders 92 and 94 each have a body formed from an insulative material, such as plastic. Hot and neutral side input contact bars 96, and 98 are each formed of a strip of conductive material, such as a metallic material. The lines 100, and 102 are each formed of a non-conductive material and of a construction that allows for easy bending while remaining resilient to fraying. Each of the lines is sufficiently resilient so as to bend upon application of pressure, for example by the blades of an electrical plug, as shown in FIGS. 15 and 16 and described in detail below, and to return to its original, substantially planar shape upon release of pressure, as shown in FIGS. 12 and 13.

With reference to FIGS. 12-15, operation of an electrical outlet receptacle 12 according to this embodiment of the invention will be described in detail. As shown in FIGS. 12 and 13, when the plug 20 is not engaged with the receptacle 12, the lines 100, 102 each have a substantially linear extension. The contact bars 96, 98 are not in communication with the hot input bar 90 in this configuration, so no current is transferred or supplied. As shown in FIGS. 14 and 15, when the plug 20 is engaged with the receptacle 12, the neutral blade 22 contacts the neutral side line 102, bending the neutral side line 102 in a rearward direction of the receptacle 12 and pulling the neutral side slider 94 outward in the direction of the neutral side 30 of the receptacle 12. At the same time, the hot blade 24 contacts the hot side line 100, bending the hot side line 100 in a rearward direction of the receptacle 12 and pulling the hot side slider 92 outward in the direction of the hot side 32 of the receptacle 12. This pulling brings the neutral side slider 94, and in turn the neutral side input contact bar 98, into contact with the hot input bar 90. At the same time, the hot side slider 92, and in turn, the hot side input contact bar 96, are brought into contact with the hot input bar 90. Accordingly, the hot input bar 90 brings the neutral side contact bar 98 and the hot side input contact bar 96 in communication with each other, completing the circuit necessary for current to be supplied to an electrical apparatus associated with the plug 20.

Figure 17:
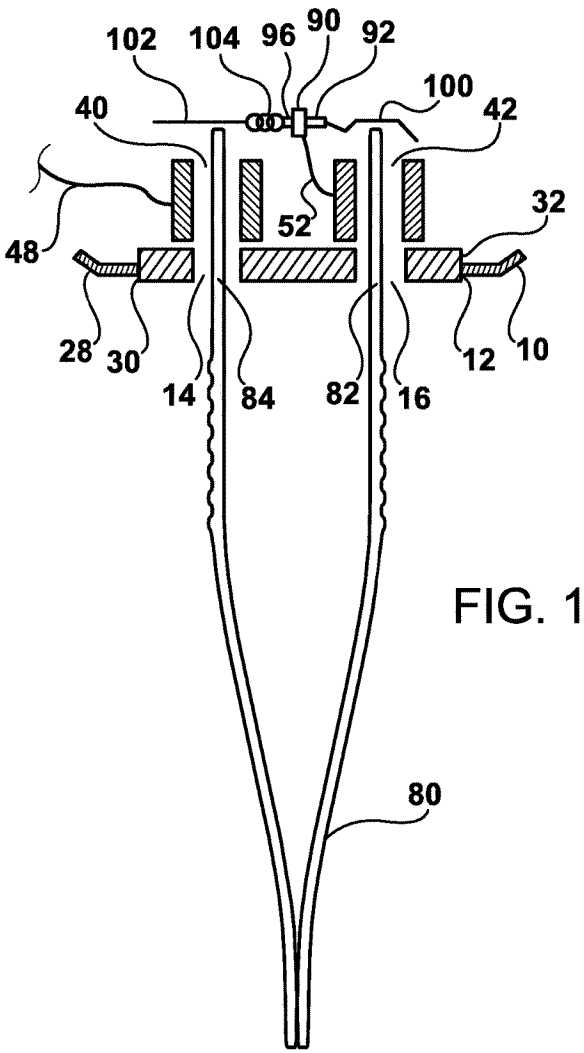
FIG. 17 is a cross sectional view similar to that of FIG. 13, but showing a pair of tweezers engaged with the outlet receptacle.
Figure 16:
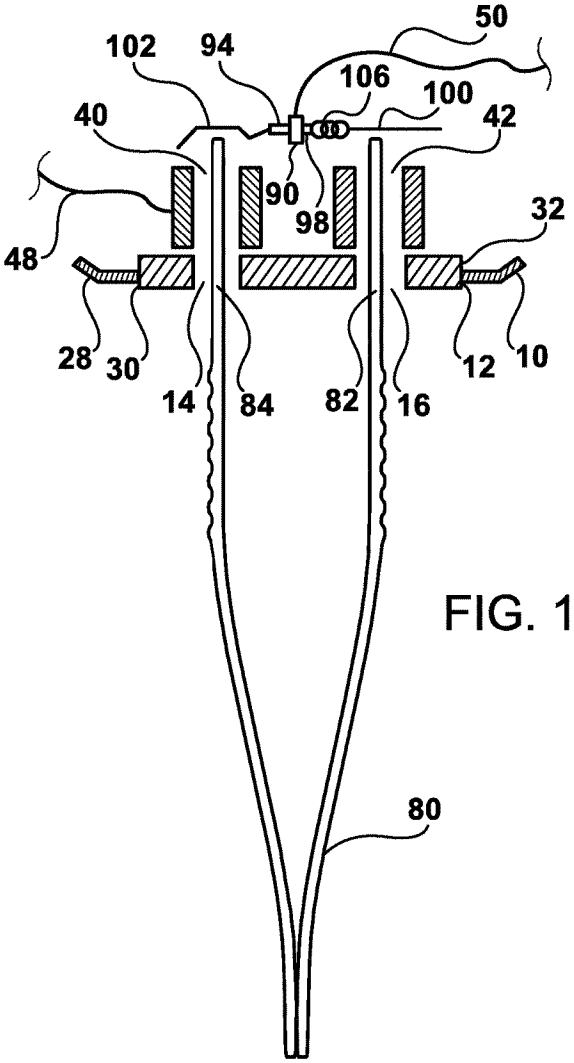
FIG. 16 is a cross sectional view similar to that of FIG.12, but showing a pair of tweezers engaged with the outlet receptacle.

Referring to FIGS. 16 and 17, two scenarios are illustrated in which a narrow, two pronged object 80 is engaged with the receptacle, which could result in a dangerous condition such as shock in the case of a conventional outlet. In the illustrated embodiment, the object 80 is a set of tweezers, but it should be understood that the outlet will respond in the same manner where other similarly sized two-pronged objects are inserted into the receptacle. As shown, a first prong 84 of the object is inserted into the neutral blade opening 14 and a second prong 82 is inserted into the hot blade opening 16. In FIG. 16, the object 80 is inserted at a first vertical position, near the lower edges of the neutral and hot blade openings 14, 16. When this occurs, the first prong 84 may bend the neutral line 102 to bring the slider 94 and slider contact bar 98 into contact with hot input bar 90. Because the neutral side line 102 and hot side line 100 are vertically displaced from each other, the second prong 82 enters the hot blade opening 16 at a position below the hot side line 100. The hot side line 100 does not bend, and in turn the hot side slider 92 remains fixed and the hot side contact bar 96 remains out of contact with the hot input bar 90, failing to complete the circuit and enable current to be supplied. Similarly, FIG. 17 shows a scenario in which the object 80 is inserted at a second vertical position, near the upper edges of the neutral and hot blade openings 14, 16. When this occurs, the first prong 82 may bend the hot side line 100 to bring the slider 92 and slider contact bar 96 into contact with hot input bar 90. Because the hot side line 100 and neutral side line 102 are displaced from each other, the second prong 84 enters the neutral blade opening 14 at a position above the neutral side line 102. The neutral side line 102 does not bend, and in turn the neutral side slider 94 remains out of contact with the hot input bar 90, failing to complete the circuit and enable current to be supplied While the preferred embodiments of the invention have been described in detail above, the invention is not limited to the specific embodiments described, which should be considered as merely exemplary.

What is claimed is:

1. An electrical outlet receptacle, comprising:

a neutral side having a neutral blade opening and neutral port aligned with the neutral blade opening, the neutral port configured to receive a neutral blade of an electrical plug;

a neutral contact aligned with the neutral port;

a hot side having a hot blade opening and a hot port aligned with the hot blade opening, the hot port configured to receive a hot blade of an electrical plug;

a hot contact aligned with the hot port; and a connector bar having a neutral tab extending into the neutral side of the receptacle and located between the neutral port and the neutral contact, and a hot tab extending into the hot side of the receptacle and located between the hot port and the hot contact;

wherein the neutral tab and the hot tab are offset from each other.

2. The electrical output receptacle of claim 1, wherein the neutral tab and the hot tab are vertically offset from each other.

3. The electrical output receptacle of claim 2, wherein the neutral tab is located at a first vertical position proximate to a bottom edge of the neutral port and the hot tab is at a second vertical position proximate to a top edge of the hot port.

4. The electrical outlet receptacle of claim 3, wherein the connector bar further comprises a vertical link extending between the neutral tab and the hot tab.

5. The electrical outlet receptacle of claim 4, wherein the one of the neutral tab or the hot tab extends perpendicularly outward from an upper end of the link, and the other of the neutral tab or the hot tab extends perpendicularly outward from a lower end of the link.

6. The electrical output receptacle of claim 1, wherein the connector bar has a front surface facing the hot port and the neutral port, the front surface being formed of an insulative material, and a rear surface facing the hot contact and the neutral contact, the rear surface being formed of a conductive material.

7. The electrical output receptacle of claim 6, wherein the neutral tab is configured to bend and bring a first area of the rear surface in contact the neutral contact and the hot tab is configured to bend and bring a second area of the rear surface in contact the hot contact.

8. The electrical output receptacle of claim 1, wherein the neutral tab and the hot tab are resiliently bendable.

9. The electrical output receptacle of claim 8, wherein the neutral tab is configured to bend and contact the neutral contact and the hot tab is configured to bend and contact the hot contact.

10. The electrical output receptacle of claim 9, wherein the neutral tab is configured to bend in response to force applied by insertion of the neutral blade of an electrical plug and the hot tab is configured to bend in response to force applied by insertion of the hot blade of an electrical plug.

11. The electrical outlet receptacle of claim 9, wherein the neutral tab and the hot tab form a complete electrical circuit to supply power to the receptacle when bent simultaneously.

12. An electrical outlet receptacle, comprising:

a neutral side having a neutral blade opening and neutral port aligned with the neutral blade opening, the neutral port configured to receive a neutral blade of an electrical plug;

a neutral contact located rearward of the neutral port;

a hot side having a hot blade opening and a hot port aligned with the hot blade opening, the hot port configured to receive a hot blade of an electrical plug;

a hot contact located rearward of hot port; and a neutral tab located between the neutral port and the neutral contact at a first vertical position, and a hot tab connected to the neutral tab and located between the hot port and the hot contact at a second vertical location that is offset from the first vertical position.

13. The electrical outlet receptacle of claim 12, wherein the neutral tab and the hot tab each have an electrically insulative front surface and an electrically conductive rear surface.

14. The electrical outlet of claim 13, wherein the neutral tab and the hot tab are resiliently bendable.

15. The electrical outlet of claim 14, wherein the neutral tab is configured to bend and contact the neutral contact and the hot tab is configured to bend and contact the hot contact.

16. The electrical outlet of claim 14, wherein the electrically conductive rear surface is continuous between the hot tab and the neutral tab.

17. The electrical outlet of claim 16, wherein bending of the neutral tab brings the electrically conductive rear surface in contact with the neutral contact, and bending of the hot tab brings the electrically conductive rear surface in contact with the hot contact.

18. A method of supplying electricity to an electrical plug, comprising:

providing an electrical outlet receptacle, the receptacle comprising:

a neutral side having a neutral blade opening and neutral port aligned with the neutral blade opening, the neutral port configured to receive a neutral blade of an electrical plug;

a neutral contact aligned with the neutral port;

a hot side having a hot blade opening and a hot port aligned with the hot blade opening, the hot port configured to receive a hot blade of an electrical plug;

a hot contact aligned with the hot port; and a connector bar having a neutral tab extending into the neutral side of the receptacle and located between the neutral port and the neutral contact, and a hot tab extending into the hot side of the receptacle and located between the hot port and the hot contact;

wherein the neutral tab and the hot tab are offset from each other;

providing the plug, the plug comprising a neutral blade and a hot blade; and engaging the plug with the receptacle by inserting the neutral blade into the neutral blade opening and inserting the hot blade into the hot blade opening.

19. The method of claim 18, further comprising bending the neutral tab with the neutral blade, until the neutral tab contacts the neutral contact, and bending the hot tab with the hot blade, until the hot tab contacts the hot contact.

20. The method of claim 19, wherein the connector bar has an electrically insulative front surface and an electrically conductive rear surface, wherein a first section of the rear surface contacts the neutral contact and a second section of the rear surface contacts the hot contact, forming a complete circuit.

* * * * *